US005419157A

United States Patent [19]

Kiblawi et al.

[11] Patent Number: 5,419,157

[45] Date of Patent: * May 30, 1995

[54] AIR-CONDITIONING SYSTEM ACCUMULATOR AND METHOD OF MAKING SAME

[75] Inventors: Daniel F. Kiblawi, Rochester Hills; Dean M. Christie, Royal Oak; Todd R. Kelpin, Sterling Heights, all of Mich.

[73] Assignee: Automotive Fluid Systems, Inc., Wilmington, Del.

[ * ] Notice: The portion of the term of this patent subsequent to Feb. 1, 2011 has been disclaimed.

[21] Appl. No.: 139,571

[22] Filed: Oct. 20, 1993

Related U.S. Application Data

[63] Continuation-in-part of Ser. No. 879,808, May 7, 1992, Pat. No. 5,282,370.

[51] Int. Cl.[6] ..... F25B 43/00

[52] U.S. Cl. ..... 62/503; 29/890.06; 138/44

[58] Field of Search ..... 62/83, 503; 138/44; 29/890.06, 469.5

[56] References Cited

U.S. PATENT DOCUMENTS

| | | | |
|---|---|---|---|
| 3,798,921 | 3/1974 | Scherer et al. | 62/217 |
| 4,111,005 | 9/1978 | Livesay | 62/503 |
| 4,291,548 | 9/1981 | Livesay | 62/503 |
| 4,304,038 | 12/1981 | Yabu et al. | 29/469.5 X |
| 4,414,387 | 11/1983 | Newman | 29/469.5 X |
| 4,496,378 | 1/1985 | Kish | 55/316 |
| 5,052,193 | 10/1991 | Pettitt et al. | 62/503 |
| 5,282,370 | 2/1994 | Kiblawi et al. | 62/503 |

*Primary Examiner*—William E. Tapolcai
*Attorney, Agent, or Firm*—Remy J. VanOphem; John VanOphem

[57] ABSTRACT

An accumulator for use in an air-conditioning system wherein a refrigerant fluid is circulated. The accumulator embodies an enclosed housing defining an internal vapor chamber, an inlet tube, an outlet tube having a vapor inlet end in an upper portion of the vapor chamber, and a baffle member located within the housing between the upper and lower portions and within the vapor chamber to impede the flow of incoming partially vaporized fluid causing it to circulate within the chamber and allowing the refrigerant vapor to rise to the upper portion of the vapor chamber and to flow through the outlet tube. The baffle member is an integral part of the housing, being formed at the open end of one of two cup-shaped housing members and turning inwardly to provide a generally ring-shaped baffle member, with the cup-shaped members being joined at their open ends to complete the enclosed housing.

20 Claims, 5 Drawing Sheets

AIR-CONDITIONING SYSTEM ACCUMULATOR AND METHOD OF MAKING SAME

CROSS-REFERENCE TO RELATED APPLICATION

This application is a continuation in part of parent application Ser. No. 07/879,808, filed May 7, 1992, now U.S. Pat. No. 5,282,370, issued Feb. 1, 1994.

BACKGROUND OF THE INVENTION

1. Field of the Invention

The present invention relates to accumulator devices, particularly for vehicular air-conditioning systems, for separating moisture-laden, partially vaporized refrigerant fluid into a moisture-free refrigerant vapor having a predetermined, specific lubricating oil content.

2. Description of the Prior Art

The use of accumulators in air-conditioning systems, particularly vehicular air-conditioning systems, is well known. One is placed downstream of the evaporator, which cools the passenger compartment air as it is passed over and through the evaporator, and therefore takes in partially or completely vaporized refrigerant fluid which may or may not have a relatively small amount of condensation created water, and which will also have a small amount of lubricating oil necessary to the functioning of the compressor. The partially vaporized refrigerant fluid, being on the downstream end of the evaporator, is at a relatively low pressure, in the order of 40 psig and a raised but relatively low temperature in the order of 60° F. (there being a modest temperature rise through the evaporator of about 10° F.). The accumulator is upstream of the condenser and its purpose is to assure that only refrigerant vapor fluid passes to the compressor and that this vapor be moisture-free and include a prescribed amount of lubricating oil, and that the oil-laden vapor be free of particulates that might otherwise harm the compressor.

Thus the known accumulators basically accomplish five functions: (i) completely vaporize the refrigerant fluid, (ii) remove all water vapor, (iii) screen all particulates, (iv) inject into the outgoing vapor stream a predetermined amount of lubricating oil, and (v) act as a reservoir for the refrigerant when system demand is low. Typical examples of accumulators accomplishing these functions are shown in U.S. Pat. Nos. 3,798,921; 4,111,005; 4,291,548; 4,496,378 and 5,052,193.

The major challenges in designing such an accumulator are to provide one which is efficient, one which fits well within the system packaging—in other words, fits within the engine compartment and is easily accessible for maintenance—and one which is inexpensive to manufacture.

Of particular interest with regard to operation efficiency and manufacturing cost is the design and placement of the baffle within the interior of the accumulator which serves the purpose of separating pure vapor from liquified vapor, passing the former through the outlet and recirculating the latter until it completely vaporizes and it passes through the outlet. From the foregoing examples, those shown in U.S. Pat. Nos. 4,291,548 and 5,052,193 show a baffle which is a separate member or component designed to be placed within the system in some convenient manner, with the newer designs tending towards easily insertable, plastic, self-positioning members.

It is a purpose of the present invention to improve upon these known designs and their method of manufacture.

SUMMARY OF THE INVENTION

The present invention contemplates an accumulator design for an air-conditioning system which is efficient in its operation, includes a minimum number of parts and is less expensive to manufacture relative to known commercial designs.

The invention further contemplates integrating the accumulator housing and baffle structure to thereby reduce the overall number of parts in the accumulator and facilitate its most efficient manufacturing and assembly. The internal baffle member is formed to be an inwardly extending annular flange having a major diameter equal to the housing's diameter and a minor diameter which is between fifty and ninety-five percent that of the major diameter. Additionally, the end of the baffle member defining the minor diameter is extended toward the bottom of the accumulator.

The invention further contemplates an accumulator, as above described, wherein the incoming partially vaporized refrigerant is discharged through the inlet port below the integrated baffle whereby the refrigerant has the maximum amount of time in which to vaporize before it passes through the outlet port.

The invention further contemplates an accumulator, as above described, wherein all of the incoming, partially vaporized, moisture-laden refrigerant is caused to flow through the desiccant material provided for removing moisture from the refrigerant, and preferably forced to do so at the first point of entering the accumulator interior chamber.

The invention also contemplates an accumulator design, as above described, which readily facilitates, with no change in the interior structure and components, top-mounted inlet and outlet tubes and side-mounted inlet and outlet tubes or any combination of the above, thus facilitating the packaging of the accumulator within the engine compartment. These above objects, features and advantages of the present invention will become readily apparent from the following detailed description of the best mode for carrying out the invention when taken in connection with the accompanying drawings.

DETAILED DESCRIPTION OF THE PREFERRED EMBODIMENT

Figure 1:
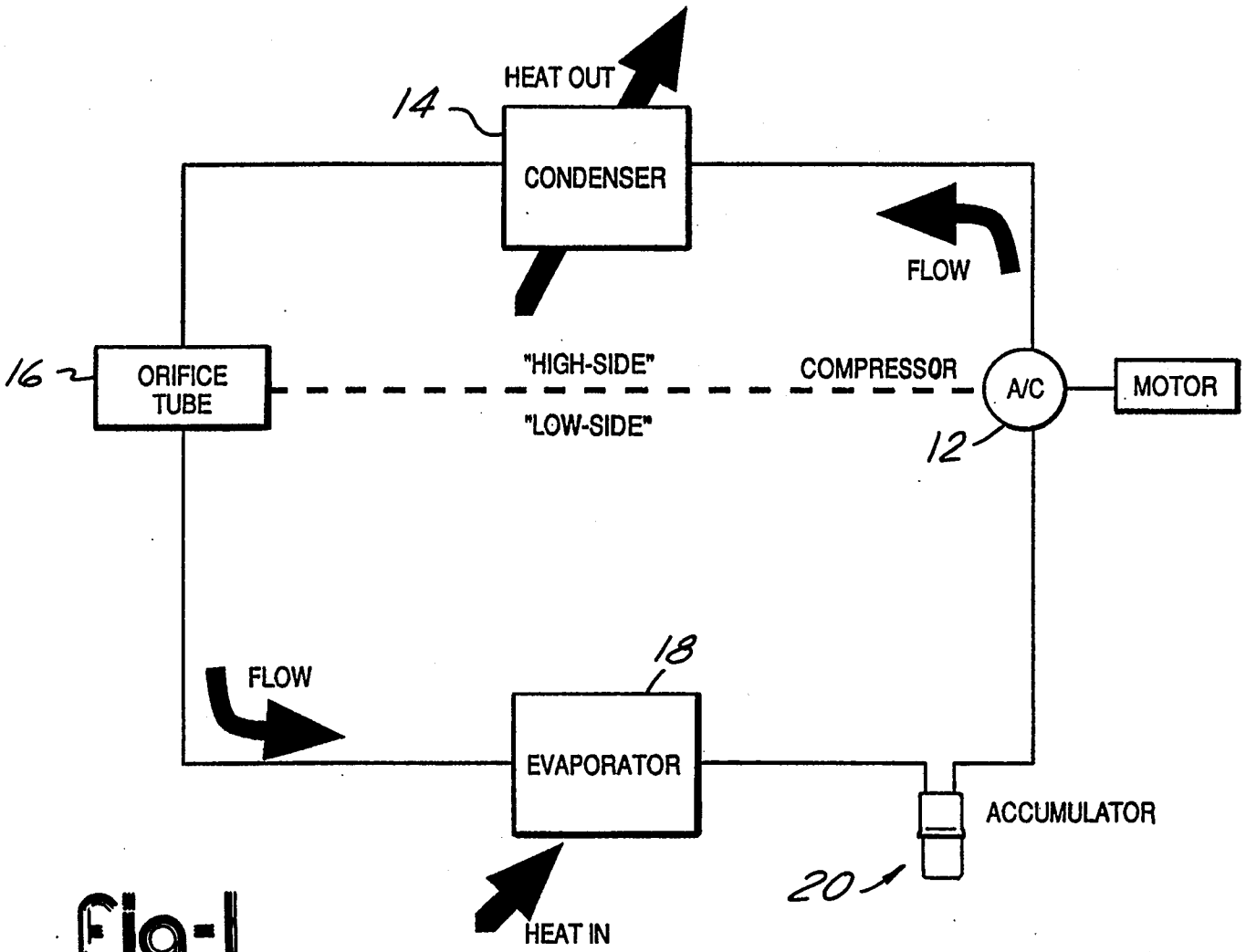
FIG. 1 is a schematic representation of a typical vehicular air-conditioning system incorporating use of an accumulator as may be designed pursuant to the present invention.

Referring to FIG. 1, there is a generally conventional vehicular air-conditioning system including a compressor 12, condenser 14, expansion device in the form of an orifice tube 16, evaporator 18 and an accumulator generally designated 20. A refrigerant fluid, such as Freon-12 or the like, is circulated through the system beginning as a high temperature/high pressure vapor on the outboard side of the compressor, then passing through the condenser, during which time additional heat is taken out of the vapor forming a high temperature/high pressure liquid, then passing through the orifice tube, causing thermal expansion of the refrigerant and thereby producing a low temperature/low pressure vapor/liquid stream passing through the evaporator which takes in heat from the heated vehicular passenger compartment and thereby transforms the refrigerant to a low temperature/low pressure vapor. At this stage, the vapor temperature is generally in the order of 64° F. and at approximately 40 psig pressure.

Figure 2:
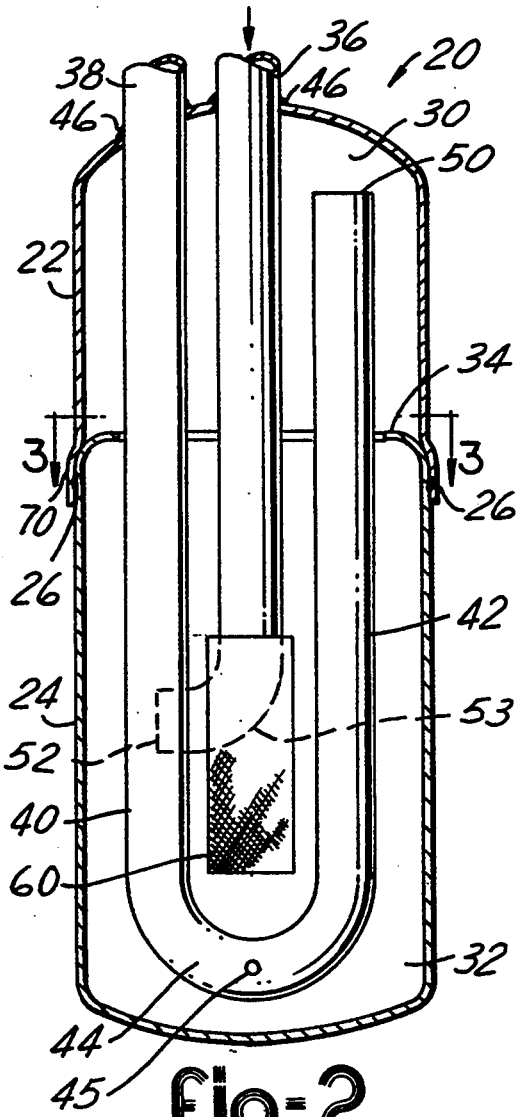
FIG. 2 is an elevational view shown partially in cross section of a first embodiment of the present invention.
Figure 3:
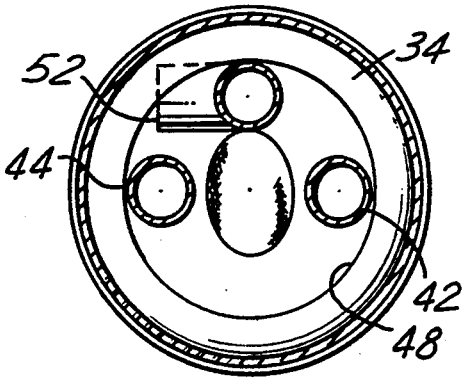
FIG. 3 is a plan view taken along section lines 3—3 of FIG. 2.

A first embodiment of an accumulator constructed in accordance with the present invention is shown in FIGS. 2 and 3 wherein the accumulator 20 has a housing composed of two cup-shaped shells 22 and 24, joined as by welding, brazing or soldering at their open end indicated at 26. The housing thereby defines an internal chamber having an upper portion 30 and a lower portion 32, generally coinciding to the boundaries of the respective cup-shaped members 22 and 24. The open, upper end of the housing member 24 is formed with a radially, inwardly directed flange or baffle member 34, which may be stamped, roll formed or spun. As described in greater detail below, the flange 34 functions as a baffle member interrupting the flow of refrigerant vapor being received within the accumulator from the evaporator or inlet end of the accumulator.

The accumulator 20 further includes an inlet tube 36 and an outlet tube 38. The inlet tube is centrally disposed off-center as viewed in the plan view of FIG. 3, i.e., its axis is parallel but not coincident with the vertical axis of the accumulator. The outlet tube 38 is a generally U-shaped member embodying two vertically oriented legs 40 and 42, with a U-shaped bight portion 44 located at a predetermined distance from the bottom of the member 24. The bight portion includes a hole 45 for allowing lubricating oil, generally found in the incoming vapor stream and collecting at the bottom of the accumulator in a manner which is well-known, to be recirculated within the outgoing vapor stream.

The hole may be capped with an orifice filter (not shown) to act as a large particle trap and to precisely meter the amount of oil flowing downstream to the compressor.

Both the inlet tube 36 and the outlet tube 38 extend through holes drilled in the top closed end of the cup-shaped member 22 and are brazed or welded thereto as indicated at 46.

It will be noted that the inlet tube 36 and the legs 40 and 42 of the outlet tube will clear an inner annular edge or rim 48 of the flange or baffle member 34. The outlet tube 38 includes an inlet end 50 located at a predetermined distance from the top wall of the cup-shaped member 22.

The inlet tube 36 includes an unrestricted, open discharge end 52 located in the chamber lower portion 32 and below the baffle member 34, at the end of an angular elbow 53. As seen in FIG. 3, the discharge end 52 is directed generally tangential to the housing wall so that, at least initially, the discharged refrigerant will assume a circumferential flow path around the circumference of the housing. A desiccant material containing member 60 such as a cylindrically-shaped flexible bag member having tightly packed silica gel particles is disposed in the lower central region of the housing member 24 and may be fixed to one or the other of the inlet and outlet tubes 36 and 38 or both, or simply rest on the bight portion 44 of the outlet tube 38. Preferably, the baffle member 34, as viewed in FIG. 2, will be located within the middle two-thirds of the length of the accumulator, i.e. the length of the lower housing member 24 will be anywhere from one-half to twice the length of the upper housing member 22.

Also, regardless of the location of the baffle member 34 along the accumulator axis, the inlet tube's discharge end 52 is preferably located above the level of any refrigerant fluid collected within the housing member 24 when it functions as a lower reservoir for refrigerant fluid, i.e. when system demand is low or the system is inoperative.

In operation, the inlet tube 36 receives a low temperature, low pressure refrigerant mixture of liquid, vapor and oil as it has passed through the evaporator 18. The refrigerant mixture will exit from the discharge end 52 of the inlet tube 36 and flow partially upward under pressure and impinge upon the baffle member 34 which will re-direct the flow downward, thus interrupting any direct flow of liquid refrigerant into the outlet tube 38 and thereby ensuring sufficient vapor flow activity within the accumulator to cause the liquid/vapor mixture to completely vaporize prior to collecting at the top of the chamber, i.e. the upper portion 30 of the cup-shaped housing 22, at which point it is caused to flow through the inlet end 50 of the outlet tube 38.

All of the refrigerant mixture is caused to flow through or about the desiccant bag member 60 whereby any moisture content is removed. The desiccant material containing member may also function as a filter for particulates, as is well-known in the art.

A mixture of lubricating oil and liquid refrigerant will precipitate out of the moisture-free, particulate-free vapor or liquid/vapor mixture and collect at the bottom of the cup-shaped lower housing 24 to be adjusted at a controlled rate through the lubricating oil orifice or hole 45 of the outlet tube 38.

The method of manufacturing the above-described accumulator includes the step of forming, as by drawing, the cup-shaped members 22 and 24. The inlet and outlet ports in the upper cup-shaped member 22 are then formed by stamping to receive the pre-formed inlet and outlet tubes 36 and 38, and upon inserting the pre-formed inlet and outlet tubes in the cup-shaped member 22, each tube is brazed or welded to the top wall as indicated at 46 in FIG. 2. Further, the bottom cup-shaped member 24 is provided with the flange or baffle member 34 by roll forming, or any other suitable process, and the open end receiving portion of the upper cup-shaped member 22 is concentrically flared as by rolling or forming at 70, sufficiently to snugly receive the flanged end of lower cup-shaped member 24. Then the desiccant containing member 60 is positioned about the inlet and outlet tubes or secured thereto as previously described, and the cup-shaped members are axially slipped together in telescopic relationship until the flange 34 of the lower housing member 24 abuts against the internal shoulder formed at the flare 70. The two cup-shaped members are then welded around the entire circumference of the flare 70 as indicated at 26.

Regarding the geometry of the baffle member 34, in all embodiments it is believed the best results are obtained where its minor diameter to major diameter ratio ranges from about 0.5:1 to 0.95:1, and preferably where the ratio equals about 0.8:1. It is also preferred that the baffle member be convex with the convex surface presented towards the bottom portion 32 of the lower housing member 24. The degree of convexity will be such as to impart good circulatory action to the refrigerant mixture being circulated past the baffle member 34.

Figure 12:
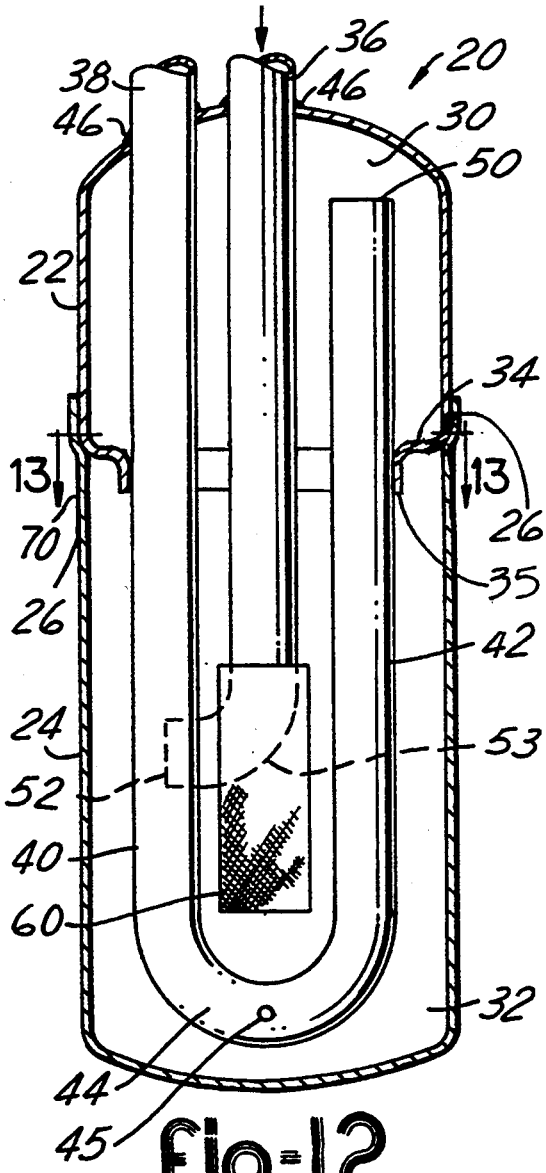
FIG. 12 is an elevational view shown partially in cross section of a sixth embodiment of the present invention.
Figure 13:
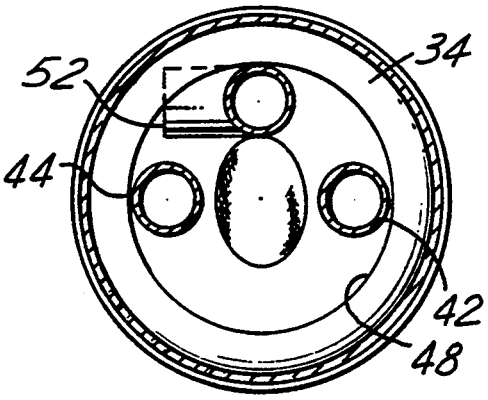
FIG. 13 is a plan view taken along the section lines 13—13 of FIG. 12 of the sixth embodiment of the present invention.

In addition to the above described preferred embodiment it should be noted that it is also possible to form the baffle member 34 in the open end of the upper cup-shaped member 22 as shown in FIGS. 12 and 13. The baffle member 34, again, can be roll formed, or made by any other suitable process. In the embodiment in which the baffle member 34 is formed in the upper cup-shaped member 22, the bottom cup-shaped member's 24 open end is concentrically flared, as by rolling or forming, sufficiently to snugly receive the upper cup-shaped member 22 having the baffle member 34 formed therein. In this embodiment, with the baffle member 34 formed in the upper cup-shaped member 22, it is still preferable to form the baffle member 34 with a convex cross section pointed toward the bottom portion 32 of the lower housing member 24 in order to impart a circulatory action to the refrigerant mixture being circulated past the baffle member 34. Additionally, it is preferable to extend the baffle member at its end 35 in a downward direction toward the bottom portion 32. This helps to direct the circulating liquid refrigerant back into the desiccant bag member 60 thereby ensuring that all of the moisture is removed from the refrigerant.

Figure 4:
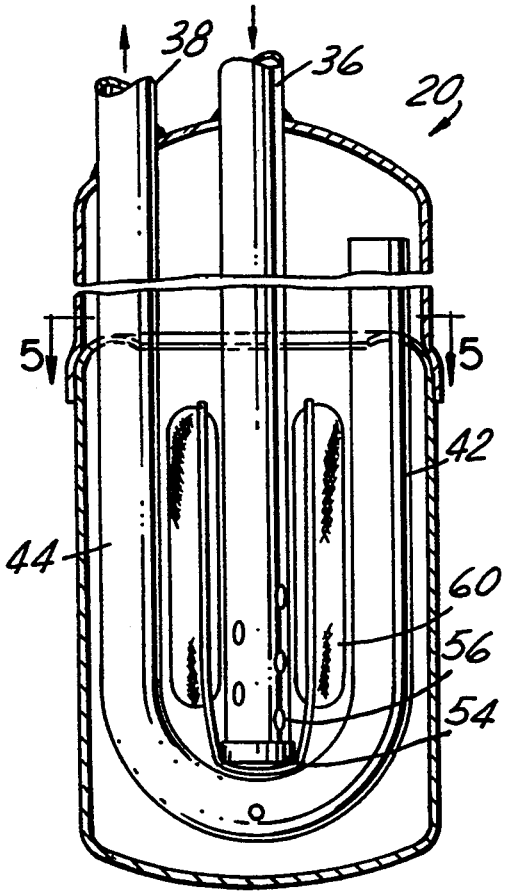
FIG. 4 is an elevational view shown partially in cross section of a second embodiment of the present invention.
Figure 5:
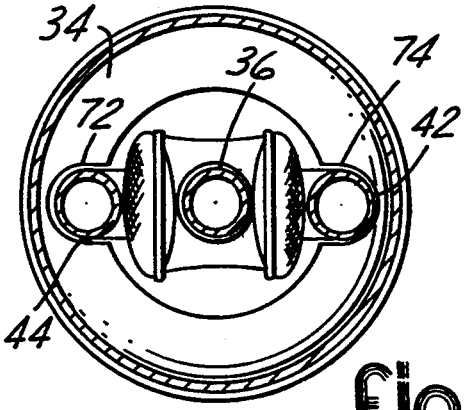
FIG. 5 is a plan view taken along section lines 5—5 of FIG. 4 of the second embodiment of the present invention.

In FIGS. 4 and 5 there is shown a second embodiment of the present invention. In this and other embodiments discussed below, like numerals are maintained where the elements are identical to those described in connection with the first embodiment of FIGS. 2 and 3. The primary difference in structure with that described in connection with the first embodiment is the structure of the baffle member 34. It will be noted from FIGS. 4 and 5 that the outlet tube legs 40 and 42 are nearly adjacent the housing members 22 and 24 and to accommodate this, it is necessary to provide diametrically opposed cut-out portion 72 and 74 in the baffle member 34 as shown in FIG. 5, which receive and locate the outlet tube relative to the accumulator housing. Preferably these cut-out portions are stamped prior to the rolling of the flange or baffle member 34. Also, the inlet tube 36 is centrally disposed coincident to the vertical axis of the accumulator, is closed at the bottom by a cap member 54 and includes a plurality of passages or holes 56 to allow the incoming refrigerant mixture to pass through the desiccant material containing member 60 and then to the lower portion 32 of the chamber. A further difference lies in the desiccant material containing member 60 which is constructed as a saddlebag, as shown generally in U.S. Pat. No. 4,291,548, the description of which is incorporated herein by reference.

Figure 6:
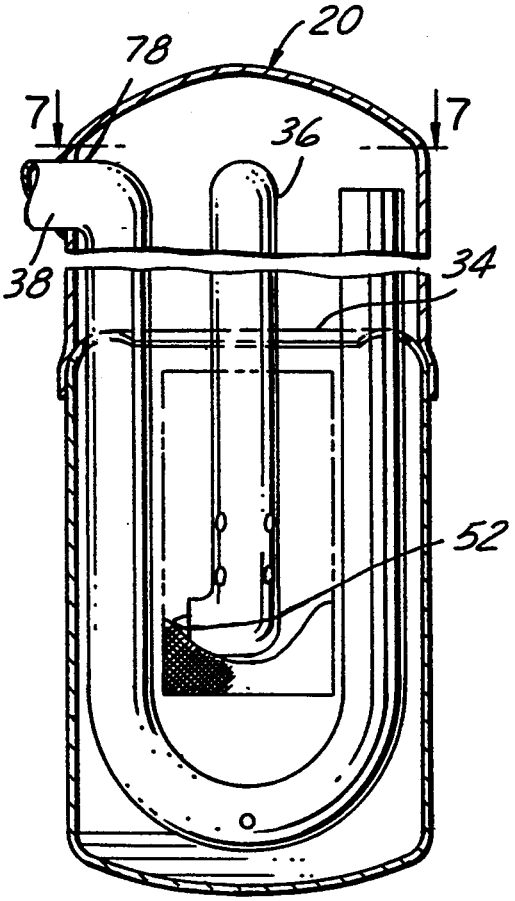
FIG. 6 is an elevational view shown partially in cross section of a third embodiment of the present invention.
Figure 7:
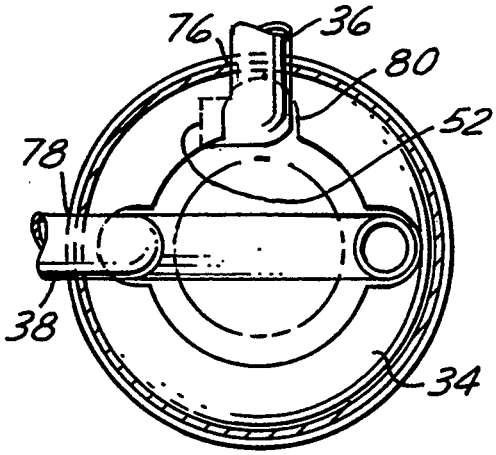
FIG. 7 is a plan view taken along section lines 7—7 of FIG. 6 of the third embodiment of the present invention.

A third embodiment is shown in FIGS. 6 and 7 wherein the inlet and outlet tubes 36 and 38 respectively, are "side-mounted", i.e., the inlet and outlet ports 76 and 78 are located in the cylindrical side wall of the upper housing member 22. Further, it will be noted that the inlet tube 36 is located radially off-center of the axis of the accumulator and disposed near the wall of the housing as with the outlet tube 38. Because of this the baffle member 34 will include a respective cut-out and locating slot or scallop 80 similar to those described in connection with the embodiment of FIGS. 4 and 5.

It will be noted that the desiccant containing member 60 is cylindrical, as was shown in the first embodiment, and remains vertically disposed in the radial center of the accumulator, adjacent to the discharge end 52 of the inlet tube 36, as seen clearly in FIG. 7. Also, the discharge end 52 of the inlet tube 36 includes no outlet holes other than being completely open at its end 52 as shown, i.e. the cap 54 of the previously described embodiment is omitted and the open discharge end 52 is positioned adjacent the desiccant member 60 and directed to the side as with the first embodiment described.

Figure 8:
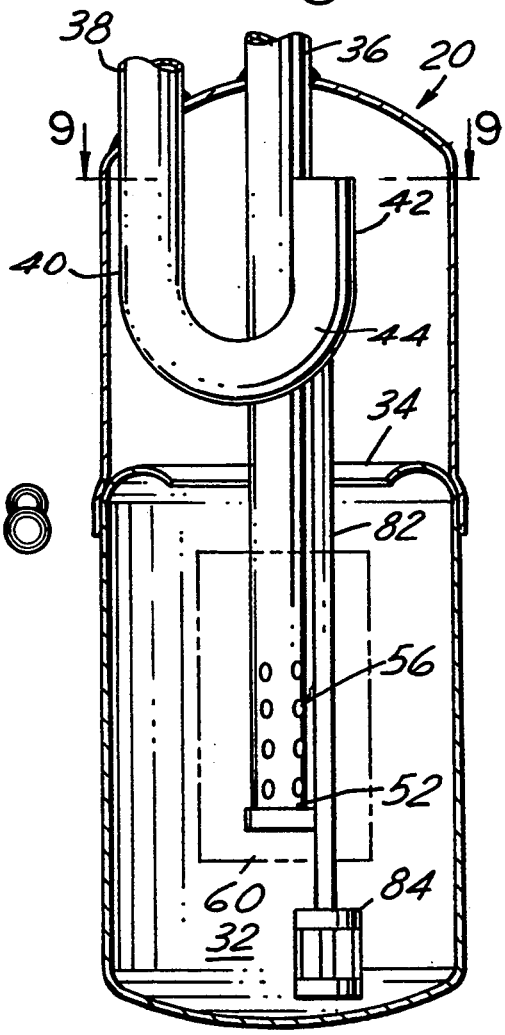
FIG. 8 is an elevational view shown partially in cross section of a fourth embodiment of the present invention.
Figure 9:
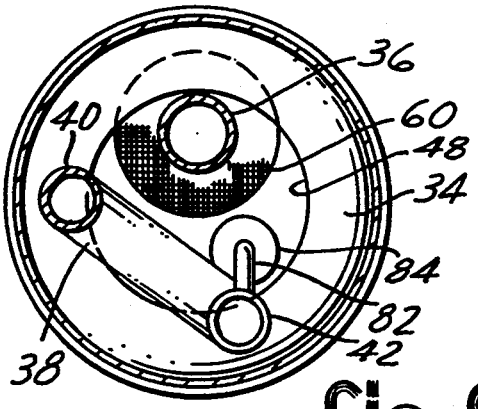
FIG. 9 is a plan view taken along section lines 9—9 of FIG. 8 of the fourth embodiment of the present invention.

Yet another embodiment of the present invention is shown in FIGS. 8 and 9. The primary difference in this embodiment with respect to those previously described is in the structure of the outlet tube 38, which it will be noted is relatively shorter in overall length than those previously described. In this embodiment, the bight portion 44 of the outlet tube 38 is located above the baffle member 34, and an oil pick-up tube 82 extends from the downstream end of the bight portion 44 to the bottom of the chamber. A screen member 84 is connected to the oil pick-up tube 82 and will filter any particulates which may be lying at the bottom of the accumulator. The rate of flow of lubricating oil is controlled by the diameter of the internal flow passage of the oil pick-up tube 82. This construction also makes possible the use of a cylindrical cartridge-type desiccant containing member 60. Its particular structure is not a part of the present invention, and any appropriate cartridge may be used, or in the alternative, a conventional saddle-bag type desiccant material containing member, as previously described, may be used. The inlet tube may be generally of the type as described in either FIGS. 2 or 4, with the latter alteration being shown. As seen in FIG. 9, the outlet tube may be disposed off-center of the accumulator axis, such that the leg members 40 and 42 are located nearest the internal wall of the accumulator. The inner annular rim 48 of the baffle member 34 is uninterrupted as is the case in the embodiment shown in FIGS. 2 and 3.

Figure 10:
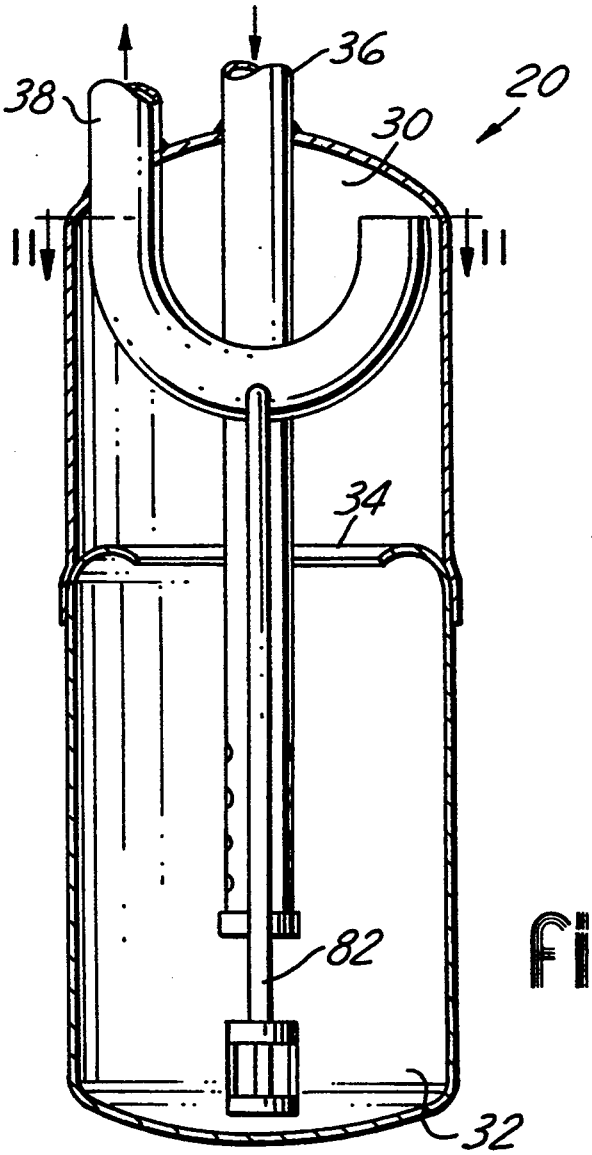
FIG. 10 is an elevational view shown partially in cross section of a fifth embodiment of the present invention.
Figure 11:
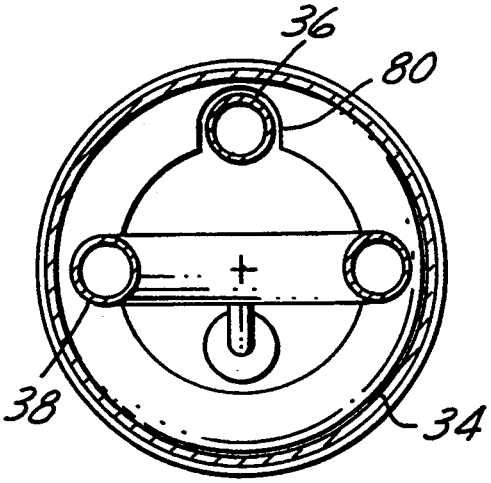
FIG. 11 is a plan view taken along section lines 11—11 of FIG. 10 of the fifth embodiment of the present invention.

Finally, in FIGS. 10 and 11 there is shown yet another embodiment of the present invention. Like the immediately preceding embodiment, the outlet tube 38 is disposed completely within the upper portion 30 of the chamber above the baffle member 34. In this case, the outlet tube 38 is centrally disposed, as seen in the plan view of FIG. 11, such that it passes through the vertical axis of the accumulator. As with the embodiment of FIGS. 8 and 9, the outlet tube 38 is connected to the elongated oil pick-up tube 82, extending to the bottom of the lower portion 32 of the chamber. The primary difference between this embodiment and that of FIGS. 8 and 9 is the location of the inlet tube 36 which is located off-center as with the embodiments of FIGS. 6 through 9, such that the baffle member 34 must include the cut-out and locating portion 80. The desiccant material containing member 60 used with this embodiment will be similar to that shown in connection with the embodiment of FIGS. 6 and 7, or in light of the lower chamber portion 32 being entirely free of the inlet tube and oil pick-up tube, a cartridge unit such as described in connection with the embodiment immediately preceding, may be utilized.

However, as with each embodiment, other than that of FIGS. 2 and 3, the baffle member 34 turns down at the annular rim or edge 48 toward the lower portion 32 of the lower cup-shaped housing 24. In FIG. 2, it is to be noted the flange 34 is not so completely developed such that the inner annular rim 48 projects radially inward approximately perpendicular to the vertical axis of the accumulator. This difference in the degree the flange is turned is not believed to materially affect the refrigerant mixture circulation, but rather accommodates the fabrication of the unit.

Although particular embodiments of the present invention have been illustrated in the accompanying drawings and described in the foregoing detailed description, it is to be understood that the present invention is not to be limited to just the embodiments disclosed. For example, it is possible to have the baffle member 34 of the embodiment shown in FIGS. 12 and 13 extend closer to the center axis of the cylinder housing and to have scallops cut into the baffle member 34 which have the inlet tube 36 and outlet tube 38 passing through the scallops, similar to the embodiment in FIG. 7. Additionally, numerous rearrangements, modifications and substitutions are possible, without departing from the scope of the claims hereafter.

What is claimed is:

1. An accumulator for use in an air-conditioning system wherein a partially vaporized refrigerant is circulated, said accumulator comprising:

a housing defining an internal chamber, said housing comprising a first portion and a second portion, said first and second portions of said housing each having a closed end and an open end, said open end of one of said first and second portions of said housing having an inwardly extending annular flange defining an opening, said inwardly extending annular flange being a baffle member to impede the flow of said partially vaporized refrigerant, such that said baffle member causes said partially vaporized refrigerant to circulate within said internal chamber of said housing;

an inlet tube passing through said housing and into said internal chamber; and an outlet tube passing through said housing and into said internal chamber, said outlet tube having a refrigerant inlet port spaced a predetermined distance from said closed end of said first portion, whereby said baffle member located within said internal chamber of said housing impedes the flow of incoming partially vaporized refrigerant causing it to circulate within said internal chamber until said partially vaporized refrigerant completely vaporizes such that the completely vaporized refrigerant flows past said baffle member and into said refrigerant inlet port of said outlet tube.

2. The accumulator of claim 1, wherein said inwardly extending annular flange is an integral part of said housing and lies within a middle two-thirds of said housing.

3. The accumulator of claim 1, wherein said inlet tube further comprises an outlet port located in said second portion of said housing.

4. The accumulator of claim 1, wherein said outlet tube is a U-shaped tube having a bight portion therein, said bight portion of said outlet tube being located within said second portion of said housing and positioned a predetermined distance from said closed end of said second portion of said housing; and said bight portion having an oil pick-up orifice located therein to draw within a vapor stream being discharged from said accumulator a predetermined amount of lubricating oil collecting at said closed end of said second portion of said internal chamber.

5. The accumulator of claim 1 wherein said first portion of said housing has an inlet aperture and an outlet aperture therein, said inlet tube passing through said inlet aperture and said outlet tube passing through said outlet aperture.

6. The accumulator of claim 5 wherein said first portion of said housing defines a first chamber region of said internal chamber, said second portion of said housing and said baffle member define a second chamber region of said internal chamber and wherein said outlet tube has a bight portion therein, said bight portion being located within said second chamber region of said internal chamber and positioned a predetermined distance from said closed end of said second portion of said housing.

7. The accumulator of claim 6 wherein said housing is a cylinder having a predetermined diameter, said inwardly extending annular flange defining a centrally located hole is a flat ring-shaped member having a major diameter and a minor diameter, said major diameter being substantially equal to said predetermined diameter of said housing and said minor diameter being between fifty and ninety-five percent that of said major diameter, whereby said inwardly extending annular flange presents a substantial impediment between said second portion of said internal chamber and said first portion of said internal chamber.

8. The accumulator of claim 6 further comprising:

a desiccant material containing member located in said second portion of said internal chamber, and wherein said inlet tube has an outlet end located in said second portion of said housing and said desiccant material containing member is juxtaposed said outlet end of said inlet tube.

9. The accumulator of claim 7 wherein said housing is a cylinder having a predetermined diameter, a closed top end, and a closed bottom end, said closed top end defining a top wall, said closed bottom end defining a bottom wall; and said inwardly extending annular flange is located substantially within a middle one-third of said housing; said inwardly extending annular flange is a generally flat ring-shaped member having a major diameter and a minor diameter, said major diameter being substantially equal to said predetermined diameter of said housing at the location of said inwardly extending annular flange; said minor diameter ranging from about fifty percent to about ninety-five percent of said major diameter, whereby said baffle member presents a substantial impediment to a flow of refrigerant between said second portion of said internal chamber and said first portion of said internal chamber.

10. The accumulator of claim 9 wherein said baffle member has a concave surface in a cross section taken in a plane passing through an axis of said flat ring-shaped member, said concave surface being disposed toward said second portion of said internal chamber, whereby a partially vaporized refrigerant passing upwardly toward said baffle member is caused to circulate toward said second portion of said internal chamber.

11. The accumulator of claim 10 wherein said baffle member is an integral part of said housing and lies within a middle two-thirds of said housing as measured along a vertical axis of said accumulator.

12. The accumulator of claim 10 wherein said housing is formed of an upper cylindrical member and a lower cylindrical member; and wherein said baffle member is formed integrally with one of said upper and lower cylindrical members at one end thereof.

13. The accumulator of claim 1 wherein said baffle member further comprises an extension member proximate said opening of said inwardly extending annular flange defining said baffle member, said extension member being positioned to extend in a direction substantially perpendicular to said inwardly extending annular flange.

14. A method of making an accumulator for an air-conditioning system, said method comprising the steps of:

providing first and second cylindrical cup-shaped members, each having an open end and a closed end;

selecting one of said first and second cylindrical cup-shaped members to constitute an upper portion of said accumulator;

selecting the other of said first and second cylindrical cup-shaped members to constitute a lower portion of said accumulator;

forming an inlet tube having a discharge end;

forming an outlet tube having a vapor inlet end;

attaching said inlet and outlet tubes to said upper portion of said accumulator such that said discharge end of said inlet tube extends beyond said open end of said upper portion, and such that said vapor inlet end of said outlet tube is located a predetermined distance from said closed end of said upper portion;

forming said open end of said lower portion to turn inward to provide a generally ring-shaped baffle member; and joining together said open ends of said upper and said lower portions to thereby provide an enclosed vapor chamber having a baffle member positioned intermediate said closed ends of said upper and said lower portions of said accumulator.

15. The method of claim 14 further comprising the steps of:

forming a scallop in said baffle member; and aligning one of said inlet and said outlet tubes in said scallop in said baffle member.

16. A method of making an accumulator for an air-conditioning system, said method comprising the steps of:

providing first and second cylindrical cup-shaped members, each having an open end and a closed end;

making an inlet hole and an outlet hole in said first cylindrical cup-shaped member;

inserting an inlet tube in said inlet hole of said first cylindrical cup-shaped member;

inserting an outlet tube in said outlet hole of said first cylindrical cup-shaped member;

forming an open end of one of said first and second cup-shaped members to turn inward to provide a generally ring-shaped baffle member; and joining together said first and second cup-shaped members at said open ends to thereby provide an enclosed vapor chamber having a baffle member positioned intermediate said closed ends of said first and second cup-shaped members of said accumulator.

17. The method of claim 16 wherein said forming step further comprises the step of:

forming said open end of one of said first and second cup-shaped members to have a concave cross section facing said closed end of said second cup-shaped member.

18. The method of claim 16 further comprising the steps of:

forming a scallop in said baffle member; and aligning said inlet tube in said scallop.

19. The method of claim 16 further comprising the steps of:

forming a scallop in said baffle member; and aligning said outlet tube in said scallop.

20. The method for making an accumulator for an air conditioner of claim 16 wherein said step of forming an open end in one of said first and second cup-shaped members to turn inward further comprises the step of forming said open end to turn downward toward said closed end of said cup-shaped member.

* * * * *

UNITED STATES PATENT AND TRADEMARK OFFICE

CERTIFICATE OF CORRECTION

PATENT NO. : 5,419,157

DATED : May 30, 1995

INVENTOR(S) : Daniel F. Kiblawi, Dean M. Christie and Todd R. Kelpin

It is certified that error appears in the above-indentified patent and that said Letters Patent is hereby corrected as shown below:

Title page, item [57], line 1, after "accumulator" insert ---- and a method for making an accumulator ----.

Title page, item [57], line 15, after "inwardly" insert ---- and then extending downward ----.

Title page, item [57], line 16, delete ", with the cup-shaped members being" and insert ---- . The cup-shaped members are ----.

Column 5, line 12, after "of" insert ---- the ----.

Column 5, line 65, delete "portion" and insert ---- portions or scallops ----.

Column 10, line 26, after "second" insert ---- cylindrical ----.

Column 10, line 29, after "second" insert ---- cylindrical ----.

Column 10, line 33, after "second" insert ---- cylindrical ----.

Column 10, line 37, after "second" insert ---- cylindrical ----.

Column 10, line 39, after "second" insert ---- cylindrical ----.

UNITED STATES PATENT AND TRADEMARK OFFICE

CERTIFICATE OF CORRECTION

PATENT NO. : 5,419,157

DATED : May 30, 1995

INVENTOR(S) : Daniel F. Kiblawi, Dean M. Christie and Todd R. Kelpin

It is certified that error appears in the above-indentified patent and that said Letters Patent is hereby corrected as shown below:

Column 10, line 49, delete ---- for making an accumulator for an air conditioner ----.

Column 10, line 52, after "second" insert ---- cylindrical ----.

Column 10, line 54, after "said" insert ---- second cylindrical ----.

Signed and Sealed this

Thirty-first Day of October 1995

*Attest:*

Bruce Lehman

BRUCE LEHMAN

*Attesting Officer*

*Commissioner of Patents and Trademarks*